US008708149B2

(12) United States Patent
Hawry et al.

(10) Patent No.: US 8,708,149 B2
(45) Date of Patent: Apr. 29, 2014

(54) FLIP CONTAINER FOR BLISTER CARD MEDICATION HOLDERS

(71) Applicant: Berlin Packaging, LLC, Chicago, IL (US)

(72) Inventors: Liam Hawry, Chicago, IL (US); Brett Niggel, St. Corry, PA (US); Scott Jost, Glen Ellyn, IL (US)

(73) Assignee: Berlin Packaging, LLC, Chicago, IL (US)

( * ) Notice: Subject to any disclaimer, the term of this patent is extended or adjusted under 35 U.S.C. 154(b) by 1 day.

(21) Appl. No.: 13/666,007

(22) Filed: Nov. 1, 2012

(65) Prior Publication Data

US 2013/0112586 A1 May 9, 2013

Related U.S. Application Data

(60) Provisional application No. 61/555,059, filed on Nov. 3, 2011.

(51) Int. Cl.
*B65D 83/04* (2006.01)

(52) U.S. Cl.
USPC ..... 206/535

(58) Field of Classification Search
CPC ..... B65D 33/01; B65D 75/30–75/328; B65D 83/04
USPC ..... 206/1.5, 425, 499, 535, 536, 538, 539
See application file for complete search history.

(56) References Cited

U.S. PATENT DOCUMENTS

| | | | | |
|---|---|---|---|---|
| 2,366,886 | A | | 1/1945 | Van Tuyl |
| 3,504,788 | A | | 4/1970 | Gray |
| 3,552,595 | A | | 1/1971 | Gerner |
| 3,579,883 | A | | 5/1971 | Hayes |
| 3,630,171 | A | | 12/1971 | Huck |
| 3,737,029 | A | | 6/1973 | Serrell et al. |
| 4,125,190 | A | | 11/1978 | Davie, Jr. et al. |
| 4,340,141 | A | | 7/1982 | Fischer |
| 4,889,238 | A | | 12/1989 | Batchelor |
| 4,955,481 | A | | 9/1990 | Noviaski et al. |
| 4,974,729 | A | | 12/1990 | Steinnagel |
| 5,033,634 | A | * | 7/1991 | Batchelor et al. ..... 206/1.5 |
| 5,050,739 | A | | 9/1991 | Hannan et al. |
| 5,109,984 | A | | 5/1992 | Romick |
| 5,265,728 | A | | 11/1993 | Allendorf et al. |
| 5,323,907 | A | | 6/1994 | Kalvelage |
| 5,351,818 | A | | 10/1994 | Daneshvar |

(Continued)

OTHER PUBLICATIONS

PCT International Preliminary Report on Patentability for coresponding PCT Application, PCT/US2012/063115, Jun. 27, 2013.

(Continued)

*Primary Examiner* — Bryon Gehman
(74) *Attorney, Agent, or Firm* — Adam K. Sacharoff

(57) ABSTRACT

There is shown in three embodiments a pill blister pack container for holding a pill blister pack. The container having a first portion highedly attached to a second portion. The first portion being sized to fit within the second portion when the container is closed. Both the first and second portions have defined side walls and a front wall. In addition, the first portion includes flanges in the side walls that engage apertures in the second portion to lock the two portions. Furthermore, a least one support post extends between the two portions.

9 Claims, 4 Drawing Sheets

(56) References Cited

U.S. PATENT DOCUMENTS

| | | | | |
|---|---|---|---|---|
| 5,549,204 | A | 8/1996 | Toren | |
| 5,740,938 | A | 4/1998 | Hofmann | |
| 5,954,202 | A | 9/1999 | Mellon | |
| 6,173,838 | B1 * | 1/2001 | Brozell | 206/538 |
| 6,244,462 | B1 | 6/2001 | Ehrensvard et al. | |
| 6,253,920 | B1 | 7/2001 | Kallgren | |
| 6,293,403 | B1 | 9/2001 | Holmberg | |
| 6,338,408 | B1 | 1/2002 | Anderson | |
| 6,394,275 | B1 | 5/2002 | Paliotta et al. | |
| 6,679,381 | B1 | 1/2004 | Bush | |
| 6,708,826 | B1 * | 3/2004 | Ginsberg et al. | 206/535 |
| 6,913,149 | B2 | 7/2005 | Gelardi et al. | |
| 7,025,207 | B2 | 4/2006 | Breu et al. | |
| 7,093,736 | B2 | 8/2006 | Maietta et al. | |
| 7,150,355 | B2 | 12/2006 | Coe et al. | |
| 7,188,729 | B2 * | 3/2007 | DeJonge | 206/535 |
| 7,357,255 | B2 * | 4/2008 | Ginsberg et al. | 206/535 |
| 7,419,056 | B2 | 9/2008 | Gattefosse et al. | |
| 7,434,692 | B2 * | 10/2008 | Ginsberg et al. | 206/535 |
| RE40,612 | E | 12/2008 | Paliotta et al. | |
| 7,464,818 | B2 | 12/2008 | Gherdan et al. | |
| 7,464,819 | B2 | 12/2008 | Maietta | |
| 7,549,541 | B2 * | 6/2009 | Brozell et al. | 206/538 |
| 7,607,538 | B2 | 10/2009 | Silvenis et al. | |
| 7,617,935 | B2 * | 11/2009 | Reilley et al. | 206/1.5 |
| 7,661,534 | B2 * | 2/2010 | Saclier et al. | 206/535 |
| 8,220,636 | B2 * | 7/2012 | Beecroft et al. | 206/535 |
| 2002/0166792 | A1 | 11/2002 | Filion et al. | |
| 2004/0026293 | A1 | 2/2004 | Hughes | |
| 2004/0050748 | A1 | 3/2004 | Ehrlund | |
| 2004/0108240 | A1 | 6/2004 | Ragot | |
| 2005/0173291 | A1 | 8/2005 | Specker et al. | |
| 2006/0051457 | A1 | 3/2006 | Bougoulas et al. | |
| 2007/0138049 | A1 | 6/2007 | Bitner | |
| 2007/0227931 | A1 | 10/2007 | Shane | |
| 2008/0017542 | A1 | 1/2008 | Le et al. | |
| 2008/0202972 | A1 | 8/2008 | Prud'Homme | |
| 2008/0265011 | A1 | 10/2008 | Specker | |
| 2009/0084801 | A1 | 4/2009 | Coe | |
| 2009/0095649 | A1 | 4/2009 | Costa | |
| 2009/0166244 | A1 | 7/2009 | Seymour | |
| 2009/0184023 | A1 | 7/2009 | Brollier et al. | |
| 2010/0012544 | A1 | 1/2010 | Paliotta et al. | |
| 2010/0264054 | A1 | 10/2010 | Beecroft | |
| 2011/0186469 | A1 | 8/2011 | Sack | |

OTHER PUBLICATIONS

PCT International Search Report of coresponding PCT Application, PCT/US2012/063115, Mar. 18, 2013.

* cited by examiner 100
110
144
160
165
175
141
177
148
192
117
117'
117"

FLIP CONTAINER FOR BLISTER CARD MEDICATION HOLDERS

CROSS REFERENCE TO RELATED APPLICATIONS

The present invention is a nonprovisional application of U.S. Application Ser. No. 61/555,059 filed Nov. 3, 2011, the contents of which are incorporated herein by reference.

FIELD OF THE INVENTION

The present invention relates to various medicine or pill containers.

BACKGROUND OF THE INVENTION

There are various pill dispensers available in the marketplace and the need to provide improvements and different types exist as well. There is thus disclosed herein one or more embodiments directed to holding pills and/or pill blister packs.

SUMMARY OF THE INVENTION

In one embodiment of the present invention there is provided a flip pill blister holder container. The number of blister packs each container holds may be different and may depend on the internal volume of each container. In summary, the container is defined by a two piece housing divided simply as a first portion highedly attached about a first edge to a second portion. The first portion includes a base and a first front wall distal to the first edge and extending away from the base. The first portion further includes a pair of first side walls also extending away from the base but further being separately positioned between the first edge and the first front wall. Each first side wall having a flange extending from the base. The second portion includes a top and a second front wall distal to the first edge and extending away from the top. The second portion further includes a pair of second side walls extending away from the top and separately positioned between the first edge and the second front wall. Each second side wall further has an aperture configured to receive and secure one of the flanges when the container is in a closed position. And wherein the first portion has an outer parameter smaller than an inner parameter defined by the second portion, such that when the container is in the closed position, a portion of the first portion fits between a portion of the second portion. Moreover, at least one support post extends between the top and the base, such that each of the at least on support post is sized to receive the at least one opening defined by the pill blister pack.

In other aspects of the embodiment, a channel is configured to extend from outside edges on the first edge and around a portion of the top containing the at least one support posts to define within the channel a support member portion. Each of the support posts is a two piece interlocking support member having a first piece extending from the base towards a second piece that extends from the top towards the first piece. Therefore, when the container is in the closed configuration, the interlocking means secures the two pieces together such that when the container is re-opened the interlocking support member maintains a secure engagement between the first and second piece interlocking support posts at the same time the top is capable of moving to an opened position.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
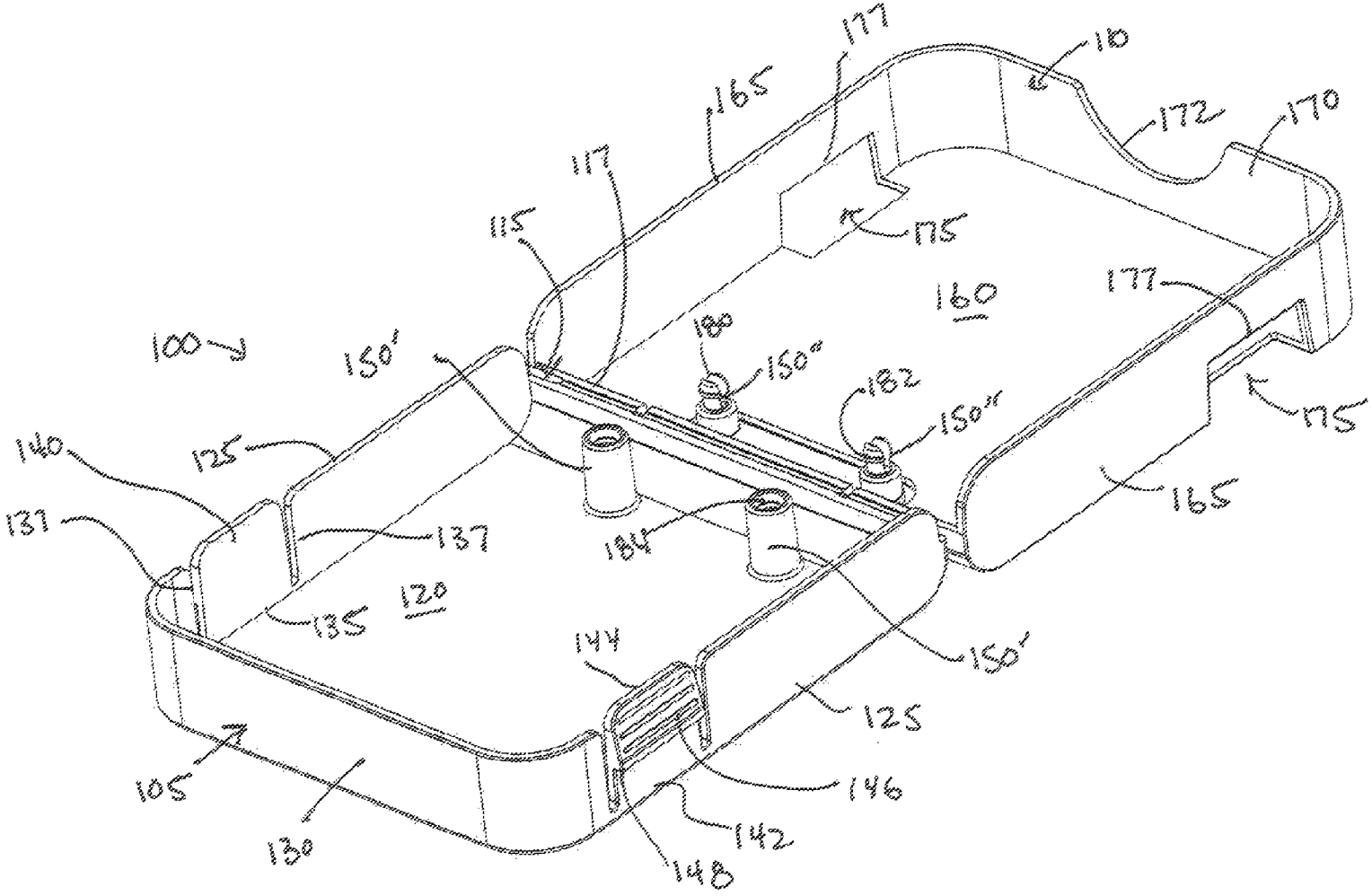
FIG. 1 is a perspective view of a first embodiment in accordance with the present invention illustrating the container is an opened configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

Referring now to FIGS. 1-4, there is shown in a first embodiment a flip closure pill blister holder container 100. The container 100 includes a bottom portion 105 and a top portion 110 hinged about adjacent edges 115. The hinge can be a living hinge 117 formed into the container or a separate means for hinging the two together.

The bottom portion 105 includes a base 120 with a pair of bottom side walls 125 and a bottom front wall 130. The bottom front wall 130 extends away from the base 120 and is distal to the adjacent edges 115. The pair of bottom side walls 125 extend away from the base 120 and are positioned between the adjacent edges 115 and the bottom front wall 130. A notch 135 is positioned in each bottom side wall 125. In one embodiment the notch 135 is positioned towards the bottom front wall 130. The notch 135 defines notch edges 137 in the bottom side wall 125. Positioned in each notch 135 is a resilient flange 140. The flange 140 includes a lower portion 142 connected to a portion of the bottom side wall 125 and an upper portion 144. The upper portion 144 may be slightly thicker then the lower portion 142 defining an intermediate flange edge 148. The flange 140 may also include a tab region 146. The flange 140 is resilient at least about the lower portion 142 to permit the flange to be pressed inwardly as discussed further below and to allow it to form back to an original position.

The top portion 110 includes a top 160 with a pair of top side walls 165 and a top front wall 170. The top front wall 170 extends away from the top 160 and is distal to the adjacent edges 115. The pair of top side walls 165 extend away from the top 160 and are positioned between the adjacent edges 115 and the top front wall 170. Each top side wall 165 includes an aperture 175 positioned and sized to receive one of the flange 140. The aperture 175 includes an intermediate aperture edge 177 configured to engage the intermediate flange edge 148.

Figure 2:
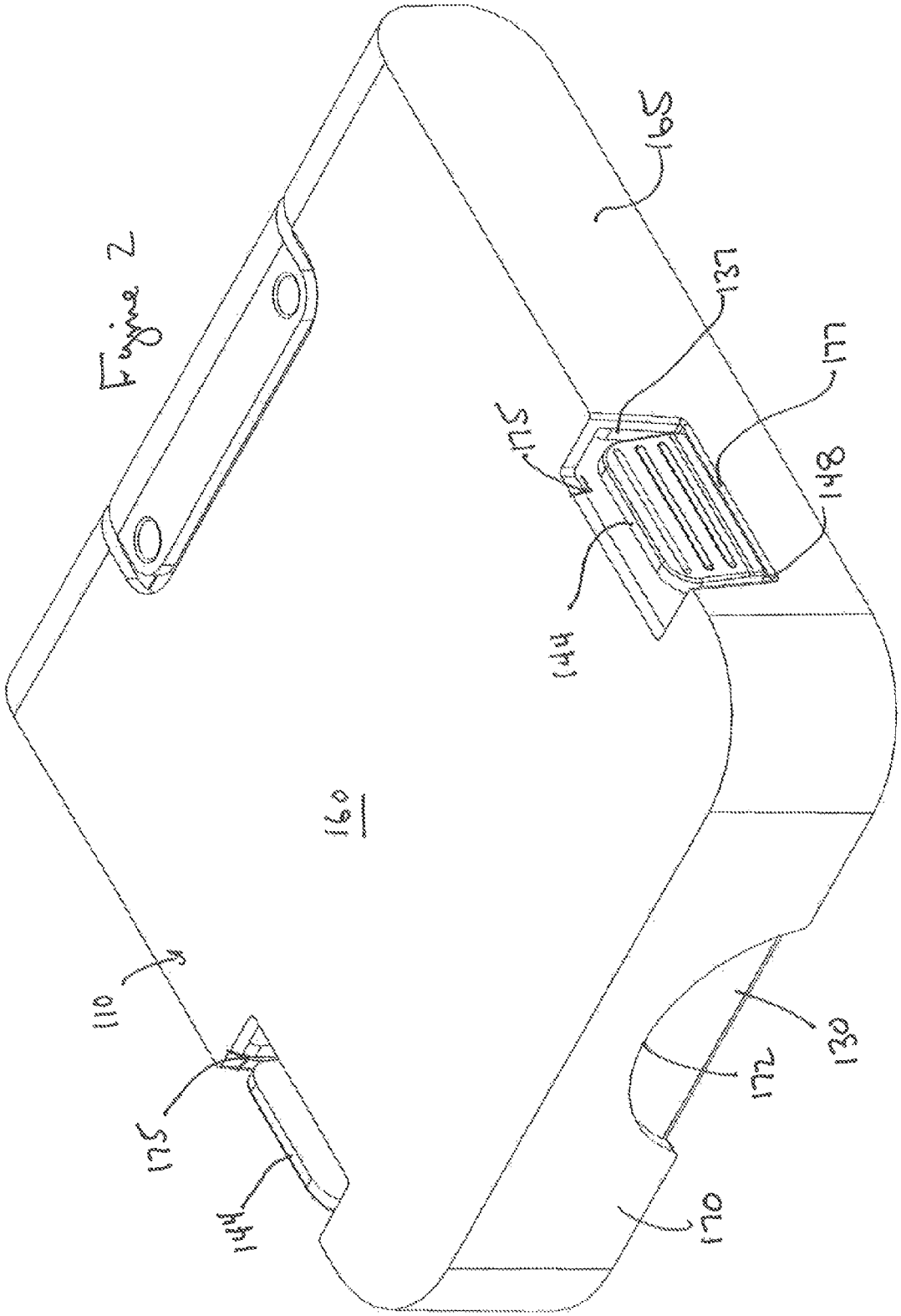
FIG. 2 is a perspective view of a container in a closed configuration.

In addition, the bottom portion has an outer diameter smaller then the top portion, such that when the container 100 is in a closed position, shown in FIG. 2, the bottom side walls fits between the top side walls. As illustrated in the closed position, the flanges 140 position in the apertures 175 such that the intermediate flange edge 148 engages the intermediate aperture edge 177, locking or securing the container 100 in the closed position. To open, the flanges are pressed inwardly until the intermediate flange edge 148 disengages the intermediate aperture edge 177. The top front wall 170 may also include a centered portion 172 curved towards the top to provide access to the bottom portion when the flanges are pressed inwardly, thereby allowing the top portion to be pulled away from the bottom portion.

Figure 3:
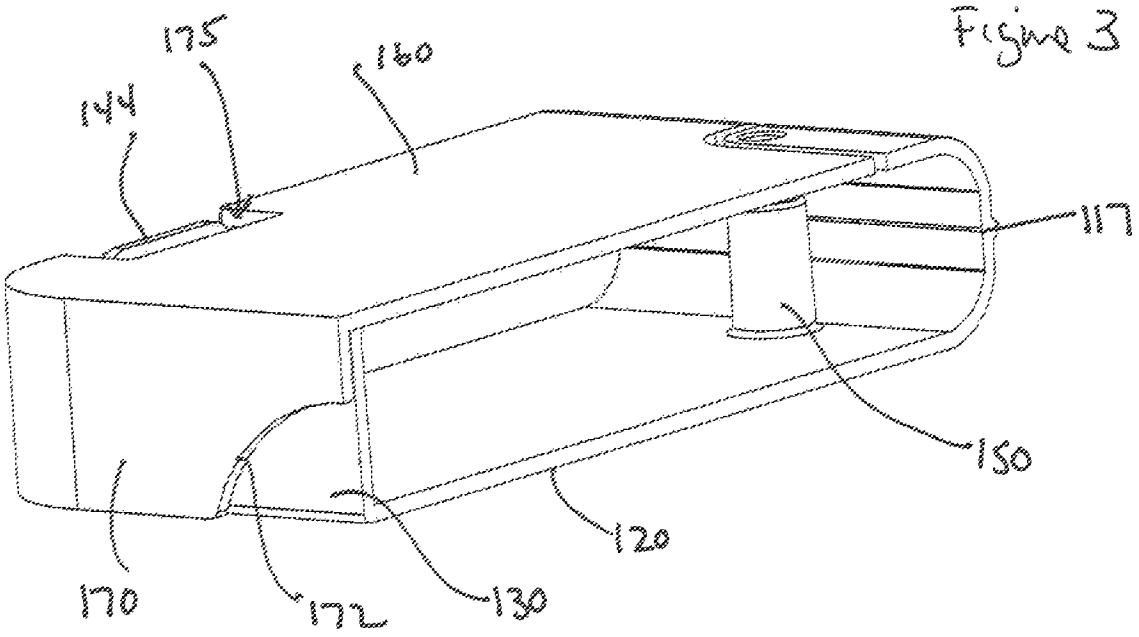
FIG. 3 is a perspective view of a cross section of the container in a closed configuration.

Continuing to refer to FIG. 1 and also now to FIG. 3, the container 100 may include at least one support member 150 extending between the top and bottom portions. The at least one support member 150 is configured to hold a blister pack or blister card. Typically the blister pack or card will having uniform openings allowing the blister pack or card to be slipped onto the support member 150. The support members 150 can be a single member or they can be a two piece support 150' and 150", each piece of the support can extend away from either the top or bottom towards the other portion. In this example, each piece of the support is configured to meet the corresponding support piece. The two piece support may be a male/female interlocking support member with the male member having a split edge 180 with outwardly extending ribs 182 configured to engage inwardly extending ribs 184 in the female interlocking support member. The split edge 180 creates multiple outwardly extending segments that can be squeezed and positioned into the female interlocking support member.

Once the blister packs are loaded onto the support members 150 and the container is closed, the multi-piece support members interlock and can be maintained in a secure closed position, even when the container is moved back to the open position.

Figure 4:
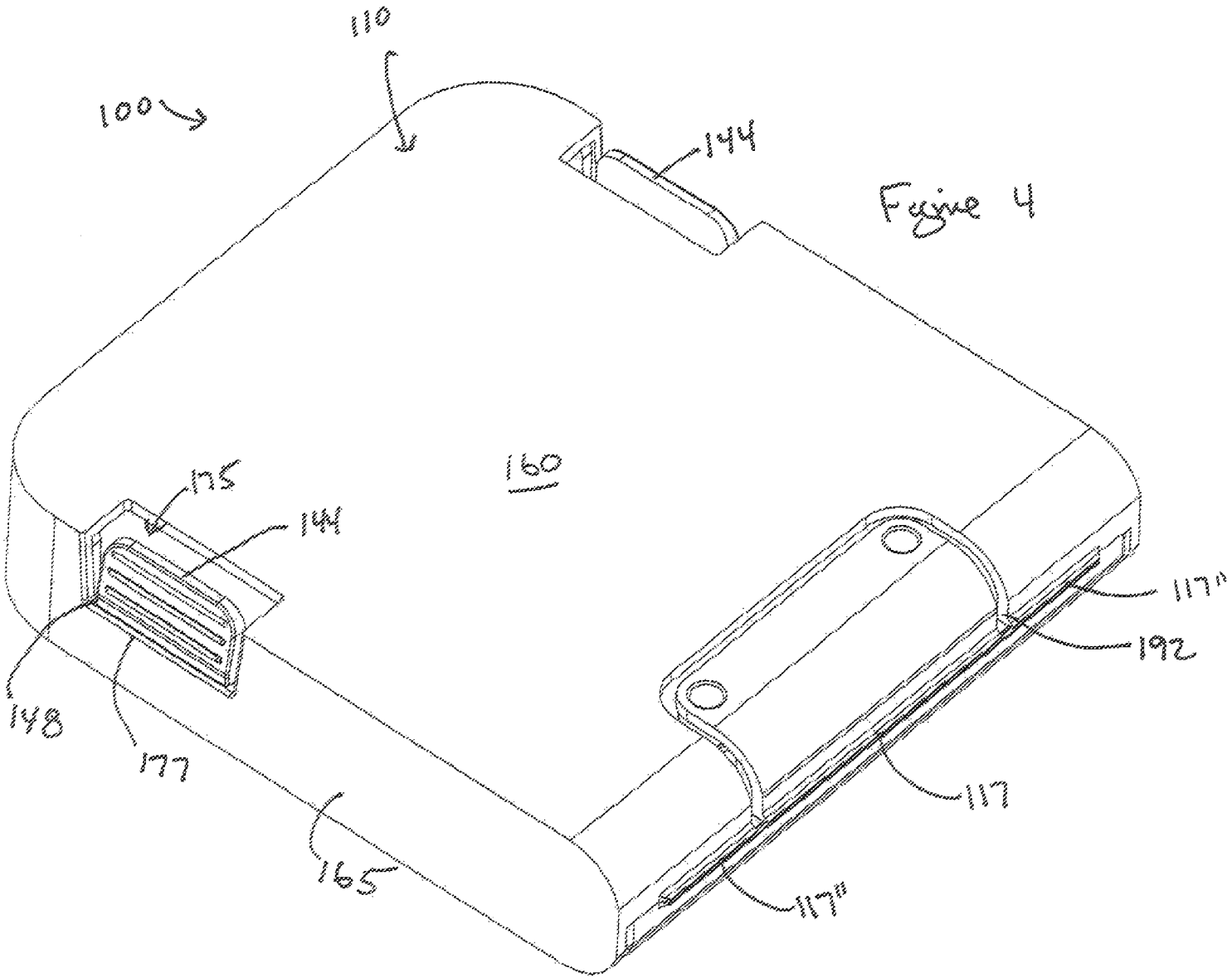
FIG. 4 is a perspective view of a container in a closed configuration.

As further provided in FIG. 4, the top portion 110 includes a support member portion 190 around the support member 150. The support member portion 190 includes a channel 192 extending from the adjacent edges 117 and moving to surround and separate the support member portion 190. When the support members 150 are interlocked, the support member portion 190 will be held in place while the rest of the top portion 110 will open about the channel 192 via outside adjacent edges 117" positioned on the outside of the channel 192. During this process the support member portion 190 stays hinged to the bottom portion.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A pill blister pack container for holding a pill blister pack, the pill blister pack having at least one opening, the container comprising:

a bottom portion highedly attached to a top portion about a first edge;

the bottom portion includes a base and a bottom front wall distal to the first edge and extending away from the base, the bottom portion further includes a pair of bottom side walls extending away from the base and separately positioned between the first edge and the bottom front wall;

a flange extending from the base and being positioned within a portion of each side wall;

the top portion includes a top and a top front wall distal to the first edge and extending away from the top, the top portion further includes a pair of top side walls extending away from the top and separately positioned between the first edge and the top front wall, and each top side wall having an aperture defined therein and being positioned to receive a flange when the container is in a closed position, and wherein the bottom portion has an outer parameter smaller than an inner parameter defined by the top portion, such that when the container is in the closed position, the bottom side walls fit between the top side walls;

at least one support post extending between the top and base, each of the at least one support post being sized to receive the at least one opening defined by the pill blister pack;

a channel extending from outside edges on the first edge and around a portion of the top containing the at least one support post to define within the channel a support member portion; and wherein each support post, of the at least one support post, is a two piece interlocking support member, the interlocking support member having a first piece extending from the base towards a second piece that extends from the top towards the first piece, the two piece interlocking support member having a means to interlock the two pieces together, and wherein when the container is in the closed configuration, the means to interlock the two pieces together secures the two pieces together such that when the container is re-opened the interlocking support member maintains a secure engagement between the first piece and the second piece of the two piece interlocking support member at the same time the top is capable of moving to an opened position about the channel.

2. The container of claim 1, wherein the top front wall further includes a centered portion curved towards the top to provide access to the bottom portion when the container is in the closed position.

3. The container of claim 1, wherein the flange is positioned within a notch defined in the side wall.

4. The container of claim 3, wherein the flange includes a lower portion connected to a portion of the bottom side wall and the flange further includes an upper portion, wherein the upper portion is thicker than the lower portion to define an intermediate flange edge positioned between the upper and lower portions.

5. The container of claim 4, wherein each aperture being further configured to an intermediate aperture edge for engagement with the intermediate flange edge when the container is in a closed configuration.

6. The container of claim 5, wherein the flange is made from a resilient material configured to permit the upper portion to be forced inwardly such that when the force is removed the flange has a tendency to return to an original configuration.

7. A pill blister pack container for holding a pill blister pack, the pill blister pack having at least one opening, the container comprising:

a housing defined into a first portion highedly attached about a first edge to a second portion;

the first portion includes a base and a first front wall distal to the first edge and extending away from the base, the first portion further includes, a pair of first side was extending away from the base and separately positioned between the first edge and the first front wall, each first side wall having a flange extending from the base;

the second portion includes a top and a second front wall distal to the first edge and extending away from the top, the second portion further includes a pair of second side was extending away from the top and separately positioned between the first edge and the second front wall, and each second side wall having an aperture configured to receive and secure one of flanges when the container is in a closed position, and wherein the first portion has an outer parameter smaller than an inner parameter defined by the second portion; such that when the container is in the closed position, a section of the first portion fits between a section of the second portion;

at least one support post extending between the top and the base, each of the at least one support post being sized to receive the at least one opening defined by the pill blister pack;

a channel extending from outside edges on the edge and around a portion of the top containing the at least one support post to define within the channel a support member portion; and wherein each of the support posts is a two piece interlocking support member, the interlocking support member having a first piece extending from the base towards a second piece that extends from the top towards the first piece, the two piece interlocking support member having a means to interlock the two pieces together, and wherein when the container is in the closed configuration, the means to interlock the two pieces together secures the two pieces together such that when the container is re-opened the interlocking support member maintains a secure engagement between the first piece and the second piece of the two piece interlocking support member at the same time the top is capable of moving to an opened position.

8. The container of claim 7, wherein the second front wall further includes a centered portion curved towards the top to provide access to the first portion when the container is in the closed position.

9. The container of claim 7, wherein the flange includes a lower portion connected to a portion of the bottom side wall and an upper portions, the upper portion being thicker than the lower portion to define an intermediate flange edge between the upper and lower portion.

* * * * *